US007409987B2

(12) United States Patent
Fjelde

(10) Patent No.: US 7,409,987 B2
(45) Date of Patent: Aug. 12, 2008

(54) DISCONNECTION DEVICE FOR A WIRELINE

(75) Inventor: Ole Gunnar Fjelde, Tau (NO)

(73) Assignee: Smedvig Offshore AS, Stavanger (NO)

( * ) Notice: Subject to any disclaimer, the term of this patent is extended or adjusted under 35 U.S.C. 154(b) by 247 days.

(21) Appl. No.: 10/551,338

(22) PCT Filed: Mar. 26, 2004

(86) PCT No.: PCT/NO2004/000088

§ 371 (c)(1),
(2), (4) Date: Jan. 18, 2006

(87) PCT Pub. No.: WO2004/093097

PCT Pub. Date: Oct. 28, 2004

(65) Prior Publication Data

US 2007/0026704 A1 Feb. 1, 2007

(51) Int. Cl.
*E21B 44/00* (2006.01)
*H01R 13/44* (2006.01)

(52) U.S. Cl. ..... 166/66.7; 439/135

(58) Field of Classification Search ..... None
See application file for complete search history.

(56) References Cited

U.S. PATENT DOCUMENTS

| | | | | |
|---|---|---|---|---|
| 4,275,786 | A | 6/1981 | Lee | |
| 4,464,812 | A | 8/1984 | Crook, Jr. et al. | |
| 5,366,018 | A * | 11/1994 | Van Steenwyk et al. | 166/385 |
| 5,810,088 | A | 9/1998 | Lamirand et al. | |
| 6,032,733 | A | 3/2000 | Ludwig et al. | |
| 6,431,269 | B1 | 8/2002 | Post et al. | |
| 6,719,479 | B1 * | 4/2004 | Marsh et al. | 403/327 |
| 6,948,560 | B2 * | 9/2005 | Marsh | 166/178 |

* cited by examiner

*Primary Examiner*—Frank S Tsay
(74) *Attorney, Agent, or Firm*—Ladas & Parry LLP

(57) ABSTRACT

A device for connection of a wireline (2) provided with a conductor (10), the wireline (2) being intended particularly for a wireline tool (4), wherein the wireline is provided with a wireline connector (6) in which each wireline strand layer (12, 14) is biased and clamped between an inner sleeve (16, 26) and an outer sleeve (18, 28), and wherein the tensile load of the wireline (2) is transmitted to a fastening element (38) via the outer sleeves (18, 28), the wireline connector (6) being connected to the wireline tool (4) by means of a releasable disconnection device (8).

10 Claims, 9 Drawing Sheets

DISCONNECTION DEVICE FOR A WIRELINE

BACKGROUND OF THE INVENTION

1. Field of the Invention

This invention concerns a device for disconnecting a wireline. More specifically, it concerns a device that is particularly suitable for disconnecting a wireline from a wireline tool, for example after having stuck the wireline tool and possibly having damaged the wireline.

2. Discussion of the Prior Art

The wireline tool may become stuck during wireline operations in a borehole. Subsequently, when the wireline tool is to be released or otherwise during unfavourable conditions and when maneuvering erroneously, the wireline may be torn off, and a portion of the damaged wireline may be left in the borehole.

In order to access the wireline tool with a fishing tool, the wireline portion located in the borehole must first be removed. The operation of removing a wireline portion of this type may be time-consuming and costly.

According to prior art, a wireline, which is to be used in wireline operations, is provided with a weakened portion near its point of connection in the wireline tool. Normally, the weakening is provided by means of removing a portion of the wireline strands. The purpose of the weakening is to attribute a potential wireline breakage to the weakened portion, thereby allowing substantially all of the wireline to be retrieved to surface after breakage. Then, the wireline tool may be retrieved by means of a so-called fishing tool.

Obviously, said method considerably reduces the carrying capacity of the wireline and therefore may cause unnecessary wireline breakages.

The object of the invention is to remedy the disadvantages of prior art.

SUMMARY OF THE INVENTION

The object is achieved in accordance with the invention and by means of the features disclosed in the following description and in the subsequent claims.

Prior art wireline tools are frequently provided with electric equipment arranged to communicate with instruments on surface during the wireline operations. Thus, it is common to provide the wireline with a central wire consisting of electric conductors, hereinafter denoted a conductor, that is arranged to transmit electric signals and possibly also electric power for operation of equipment in the wireline tool.

According to the invention, the wireline is provided with a disconnection device arranged to controllably disconnect the wireline from a connected wireline tool.

It is necessary to connect the wireline to the disconnection device by means of a wireline connector intended to withstand the full fracture load of the wireline without damaging the conductor. Advantageously, the wireline connector may also be formed having a relatively small, external sectional diameter relative to, for example, the sectional dimension of the wireline tool.

According to the invention, the wireline connector is formed in a manner allowing each strand layer of the wireline to be clamped between an inner sleeve and an outer sleeve while the conductor extends mechanically unloaded through the wireline connection.

A typical wireline of the type described herein, comprises two strand layers wound, one layer onto the other, in opposite directions about a conductor.

While connecting the wireline connector for the outer strand layer, the outer strand layer is cut at a distance from the end portion of the wireline. The outer strands are sufficiently disengaged from the inner strand layer to enable a first inner sleeve to be inserted between the outer and inner strand layers. Then, a first outer sleeve is displaced along and around the first inner sleeve and the outer strand layer. The first outer sleeve is then biased for it to clamp around the first inner sleeve and the outer strand layer placed between the first inner sleeve and the first outer sleeve, and without inflicting a significant mechanical load onto the inner strand layer. The first inner sleeve and the first outer sleeve comprise a first set of sleeves.

Correspondingly, the inner strand layer is cut somewhat closer to the end portion of the wireline, after which the inner strand layer is disengaged from the conductor, thereby allowing a second inner sleeve to be inserted along and around the conductor and underneath the inner strand layer. Then, a second outer sleeve is displaced along and around the second inner sleeve and the inner strand layer. Subsequently, the second outer sleeve is biased for it to clamp around the second inner sleeve and the inner strand layer placed between the second inner sleeve and the second outer sleeve, and without inflicting a significant mechanical load onto the conductor. The second inner sleeve and the second outer sleeve comprise a second set of sleeves.

For example, the clamping of the outer sleeves around the inner sleeves and the intermediate strand layers may be carried out by means of a wedge-like element or by means of plastic deformation if the outer sleeves.

Having carried out the clamping operation, the first and second set of sleeves, respectively, is placed at a mutual distance along the wireline length. Prior to moving the sets of sleeves into a fastening sleeve, a spacer sleeve is arranged between the two sets of sleeves, the force carried by the second set of sleeves during tensile loading thereby being transmitted to the first set of sleeves via the spacer sleeve.

The disconnection device comprises at least one locking body movably connected to the wireline tool, in which the locking body is maintained in its locking position by means of a movable body.

Preferably, disconnecting the wireline connector from the wireline tool is carried out by means of a biased release spring arranged to release by means of, for example, wires that are heated until they lose their load-carrying ability. Upon releasing, the release spring displaces the movable body away from its locking position, whereby the locking body no longer maintains its locking effect in the wireline connection.

The wireline connector and the disconnection device together constitute a significantly improved solution to a problem known for a long time. By means of the invention, it is possible to exploit the full tensile strength, even if the wireline is not provided with a conductor, and, if desirable, to disconnect a tool by means of remote control via the conductor.

The device according to the invention is well suited for all wireline applications in which the wireline is provided with a central conductor.

BRIEF DESCRIPTION OF THE DRAWING FIGS.

In the following, a non-limiting example of a preferred embodiment is described and illustrated on the attached drawing, in which.

DESCRIPTION OF THE PREFERRED EMBODIMENTS

Figure 1:
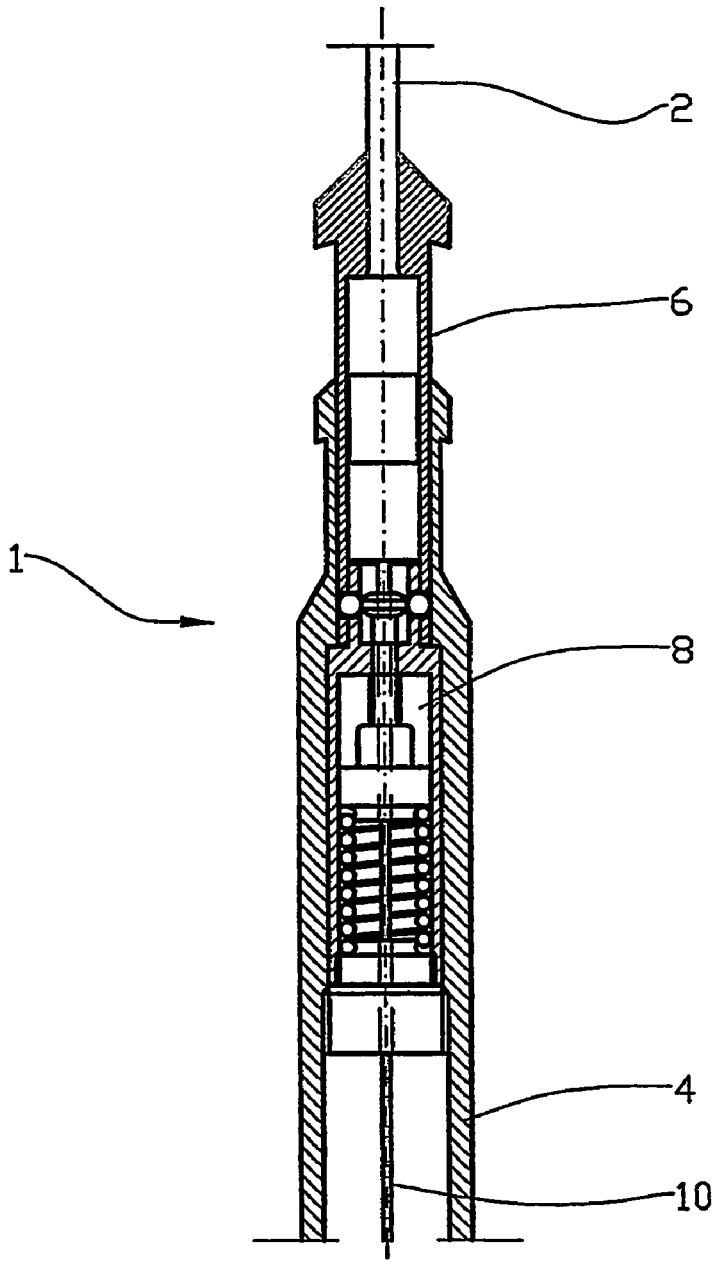
FIG. 1 shows a cross-section of a connection- and disconnection device for a wireline connected to a wireline tool.

On the drawings, reference numeral 1 denotes a connection-and disconnection device for connecting a wireline 2 to a wireline tool 4, in which the connection- and disconnection device 1 comprises a wireline connector 6 and a disconnection device 8.

Figure 2:
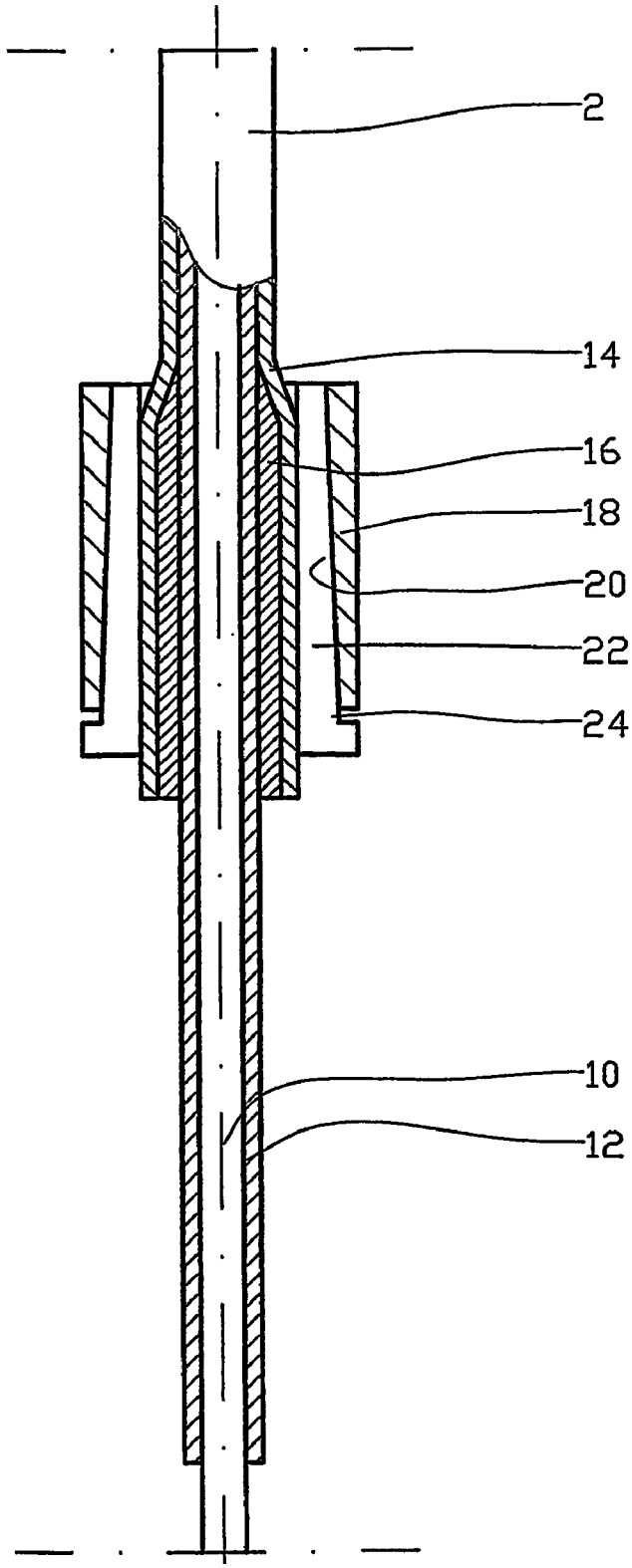
FIG. 2 shows a cross-section, and in larger scale, of a first set of sleeves mounted onto the wireline.

While referring to FIG. 2, the wireline 2 comprises a central conductor 10 enclosed by a wound inner strand layer 12. An oppositely pitched and wound outer strand layer 14 encloses the inner strand layer 12.

The outer strand layer 14 is cut at a distance from the end portion of the wireline 2, cf. FIG. 2. A first inner sleeve 16 is displaced along and around the inner strand layer 12 and underneath the outer strand layer 14, thereby allowing the strands of the outer strand layer 14 to enclose the entire length of the first inner sleeve 16.

A first outer sleeve 18 is displaced along and around the outer strand layer 14 to a position in which it encloses the first inner sleeve 16. The first outer sleeve 18 is formed with a tapered bore 20 having its largest diameter at the end portion of the outer strand layer. A first wedge sleeve 22, which preferably is split axially into two parts, and which is provided with an externally tapered surface 24 corresponding to the tapered bore 20, is biased and displaced between the first outer sleeve 18 and the outer strand layer 14.

The first outer sleeve 18 thus biases and clamps the outer strand layer 14 against the first inner sleeve 16.

Figure 3:
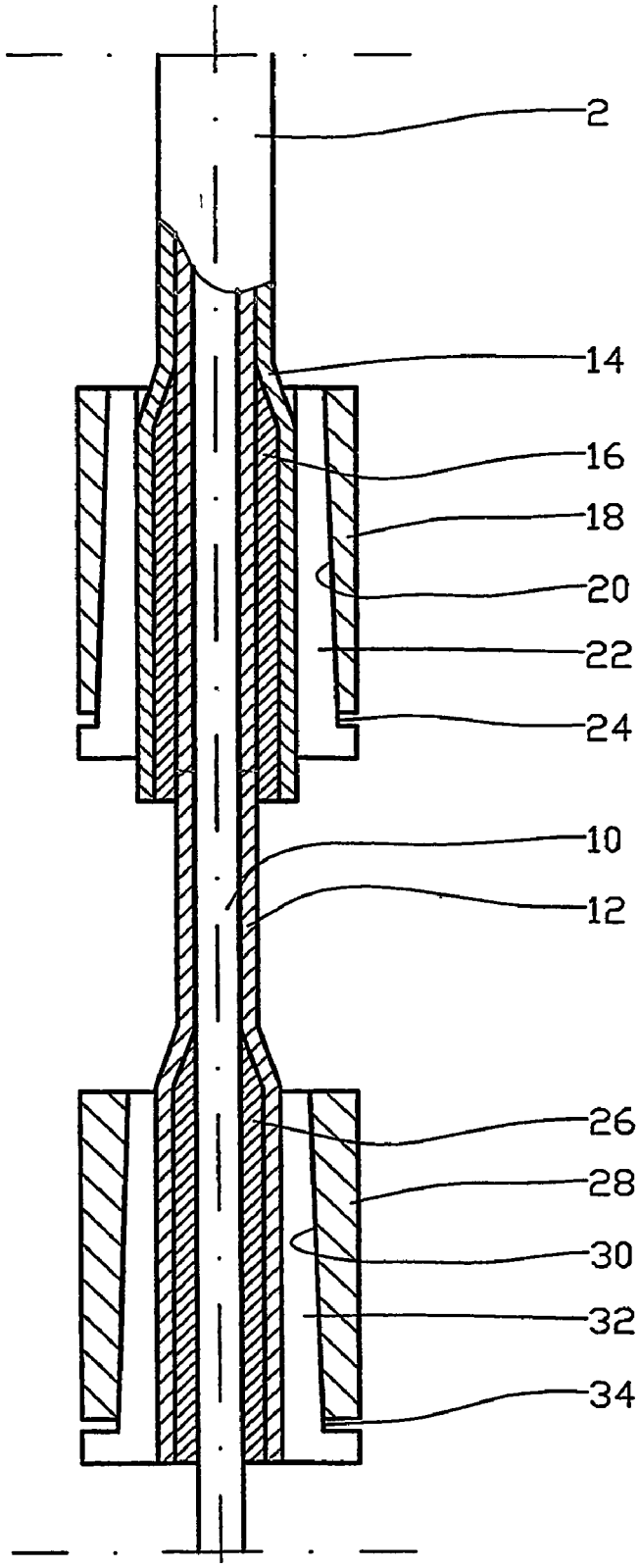
FIG. 3 shows the same as in FIG. 2, but here a second set of sleeves is also mounted onto the wireline.

The inner strand layer 12 is cut at a distance somewhat closer to the end portion of the wireline 2, cf. FIG. 3. A second inner sleeve 26 is displaced along and around the conductor 10 and underneath the inner strand layer 12, thereby allowing the strands of the inner strand layer 12 to enclose the entire length of the second inner sleeve 26.

A second outer sleeve 28 is displaced along and around the inner strand layer 12 to a position in which it encloses the second inner sleeve 26. The second outer sleeve 28 is formed with a tapered bore 30 having its largest diameter at the end portion of the inner strand layer 12. A second wedge sleeve 32, which preferably is split axially into two parts, and which is provided with an externally tapered surface 34 corresponding to the tapered bore 30, is biased and displaced between the second outer sleeve 28 and the inner strand layer 12.

The second outer sleeve 28 thus biases and clamps the inner strand layer 12 against the second inner sleeve 26.

Figure 4:
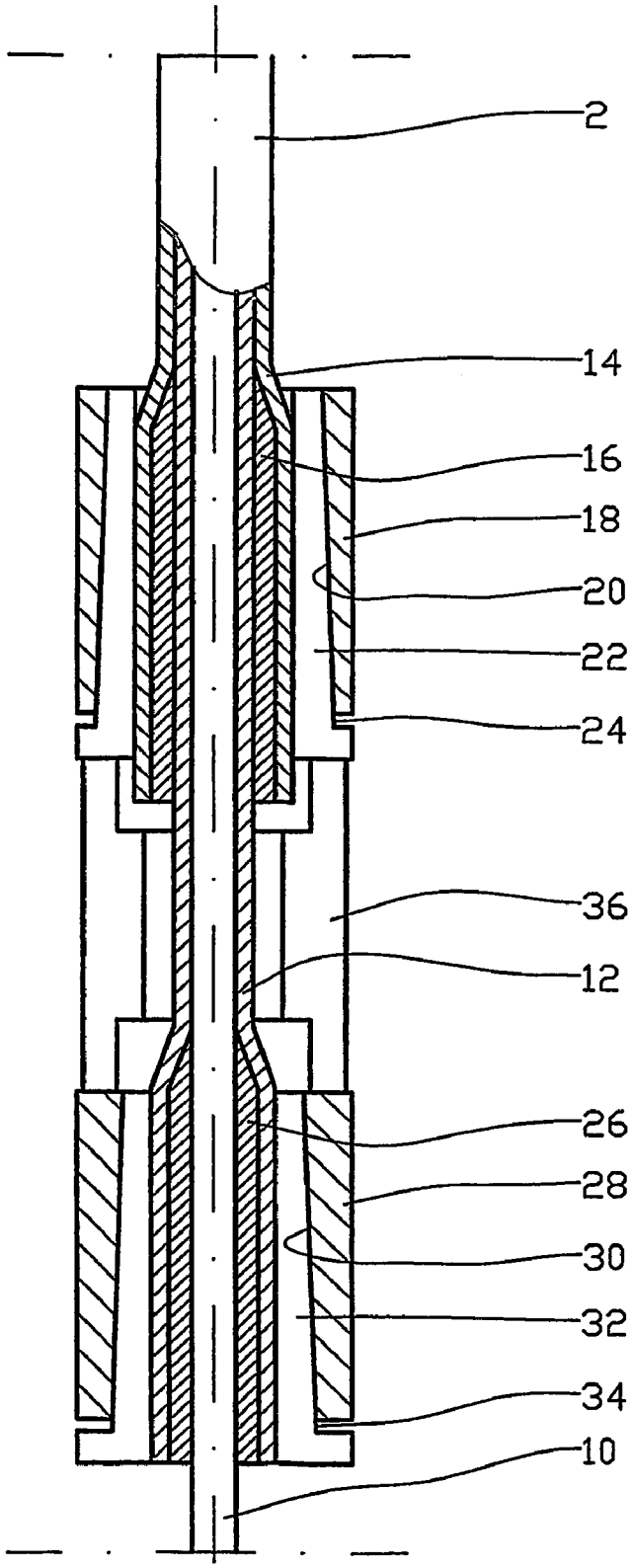
FIG. 4 shows the same as in FIG. 3, but here a spacer sleeve is mounted between the sets of sleeves.

A split, preferably two-piece, longitudinally adjusted spacer sleeve 36 is placed encircling the wireline 2 between the second outer sleeve 28 and the first wedge sleeve 22, cf. FIG. 4, the spacer sleeve 36 preferably being biased axially. The entire assembly described hereinbefore is placed within a fastening sleeve 38 fitting complementarily within a bore 40 in the upper portion of the wireline tool 4. The bore 40 terminates in a bore 41 arranged to receive the disconnection device 8.

Figure 5:
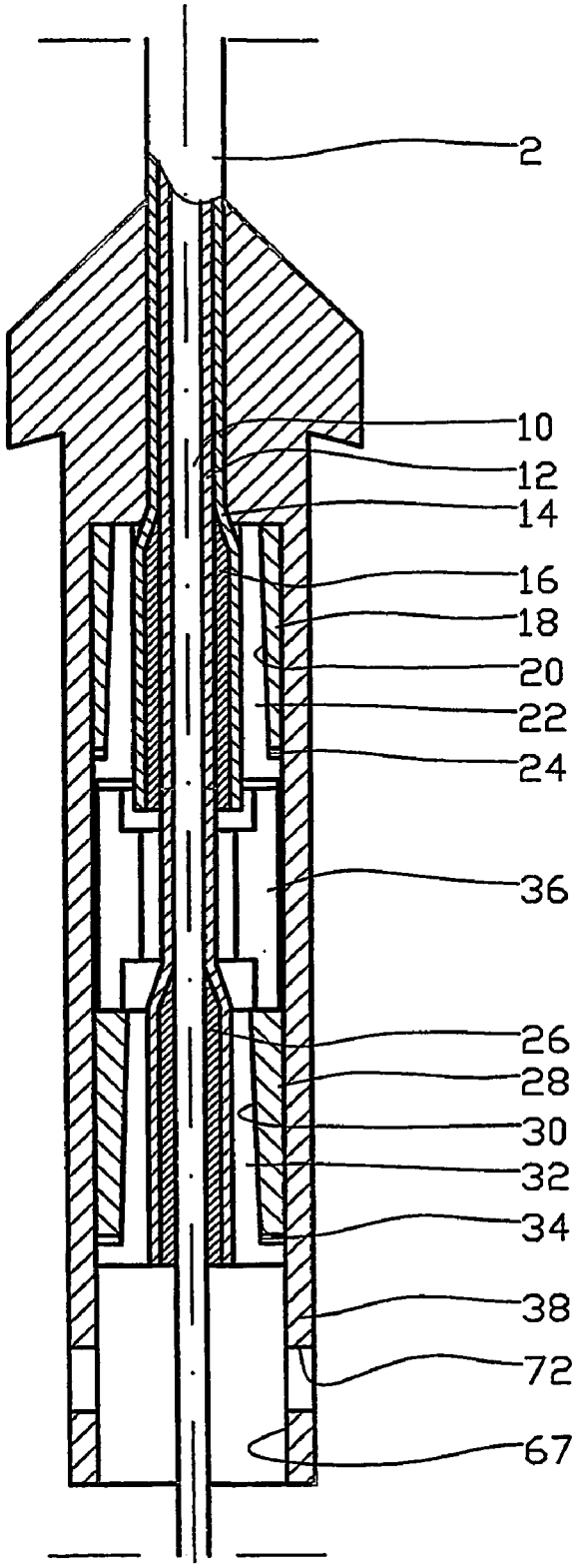
FIG. 5 shows the assembly of FIG. 4 mounted within a fastening sleeve, in which the fastening sleeve fits complementarily within the disconnection device.
Figure 6:
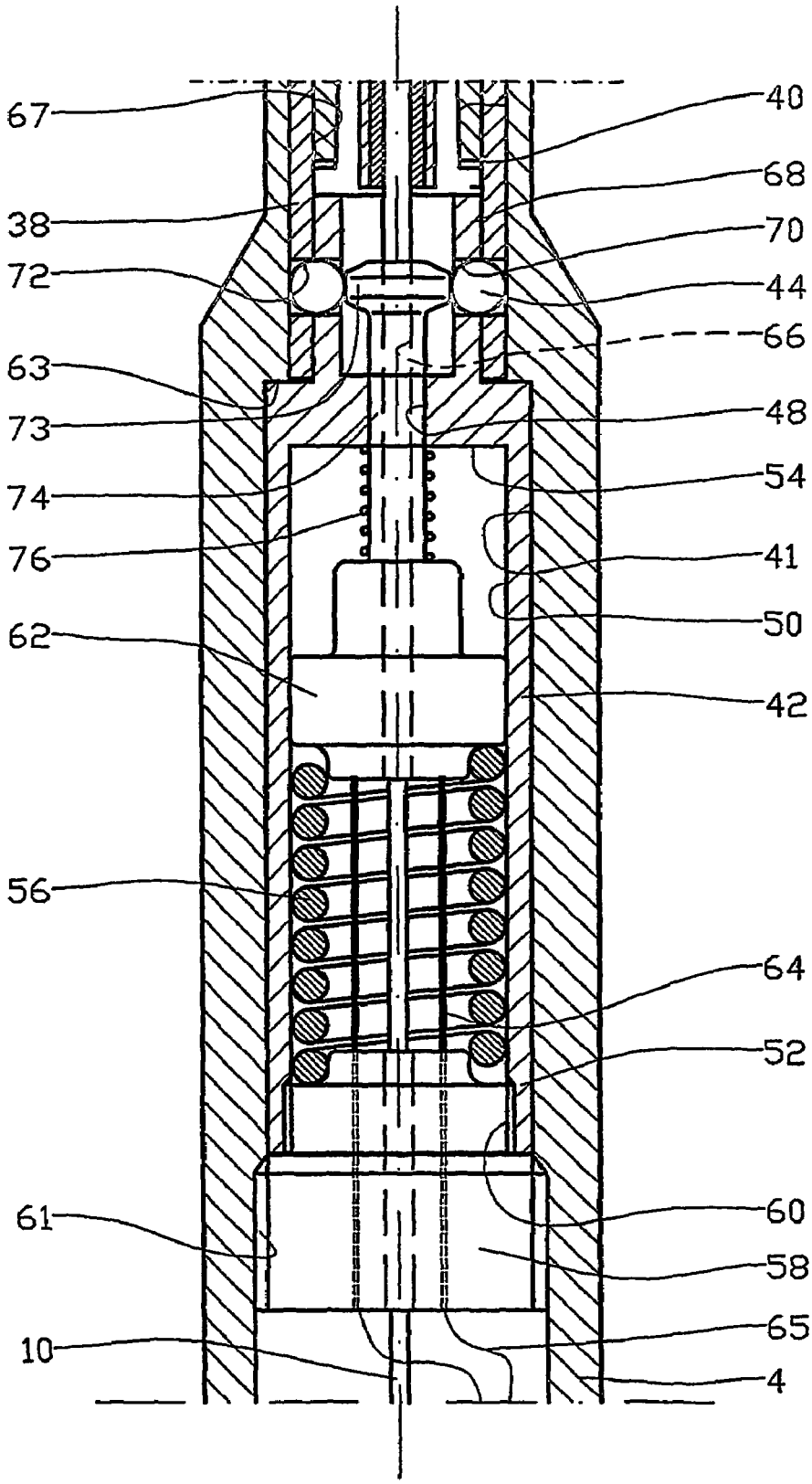
FIG. 6 shows, in larger scale, the disconnection device in a locking position.

When the wireline 2 is subjected to tension, the force from the outer strand layer 14 is transmitted by way of friction between the outer strand layer 14 and the first wedge sleeve 22, and by way of friction between the first wedge sleeve 22 and the first outer sleeve 18, onto the fastening sleeve 38, cf. FIG. 5. The force from the inner strand layer 12 is transmitted by way of friction between the inner strand layer 12 and the second wedge sleeve 32, and by way of friction between the second wedge sleeve 32, the second outer sleeve 28, the spacer sleeve 36, the first wedge sleeve 22 and the first outer sleeve 18, onto the fastening sleeve 38. Thus, the tensile force in the wireline 2 causes the wedge sleeves 22 and 32 to displace into their respective outer sleeves 18, 28, thereby increasing the clamping force against the respective inner sleeves 16, 26.

The disconnection device 8 also comprises a release housing 42 arranged within the bore 41 of the wireline tool 4, the release housing 42 being releasable by means of locking bodies 44 connected to the fastening sleeve 38 of the wireline connector 6. The release housing 42 is provided with a through-going, central bore 48 arranged to be a feed-through for the conductor 10 of the wireline 2. In a diametrically expanded portion 50 of the bore 48, in which the portion 50 extends from the lower end portion 52 of the release housing 42 and inwards to a barrier wall 54, a biased release spring 56 is placed.

The release spring 56 is biased between a spring holder 58 connected to the lower end portion 52 by means of threads 60 and a release piston 62. The release spring 56 is maintained in a biased position by a number of electrically conducive, insulated and load-carrying wires 64 extending between the spring holder 58 and the release piston 62. By means of the threads 61, the spring holder 58 is arranged to force the release housing 42 against a ledge 63 between the bores 40 and 41 in the wireline tool 4.

The wires 64, which preferably are provided with weakened portions, are connected to a voltage source by means of conductor wires 65.

The release piston 62 is provided with a through-going, central bore 66 for feed-through of the conductor 10, and it is movably arranged within the bore 48.

At its end portion facing the release housing 42, the fastening sleeve 38 is provided with an internal bore 67 fitting complementarily and externally about a locking neck 68. The locking neck 68 is provided with at least two through-going, radial and evenly distributed bores 70 corresponding to similar bores 72 in the fastening sleeve 38.

Each corresponding bore 70, 72 is provided with its own locking body 44 in the form of a ball. The diameter of the locking bodies 44 is adapted in a manner allowing the centre of the locking bodies to be on the inside of the diameter of the bore 67. The locking bodies 44 are maintained in their locking positions, in which a collar 73 on a piston-rod-resembling portion 74 of the release piston 62 prevents the fastening sleeve 38 from being displaced out of the locking neck 68. A relatively weak support spring 76 that is biased between the barrier wall 54 and the release piston 62 prevents the release piston 62 from being displaced out of its locking position.

Figure 7:
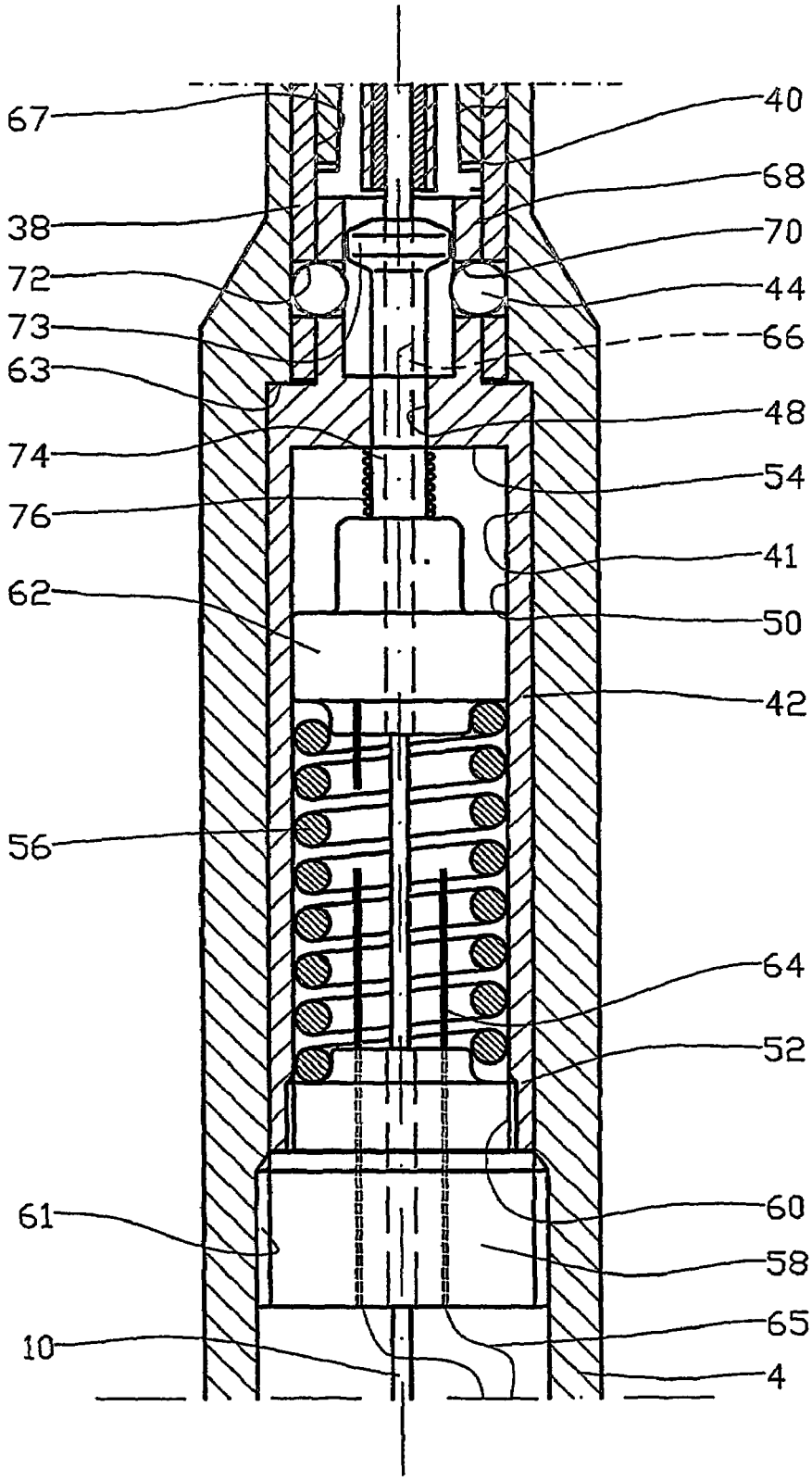
FIG. 7 shows the disconnection device when the introductory part of the releasing has been completed.

When the wireline 2 is to be released from the wireline tool 4, an electric voltage is supplied to the wires 64 via the conductor wires 65. Due to their electric resistance, the wires 64 are heated up until they lose their strength or melt, thereby allowing the release spring 56 to overcome the force of the support spring 76. The release piston 62 thus may be displaced axially within the release housing 42 to its releasing position, cf. FIG. 7.

Figure 8:
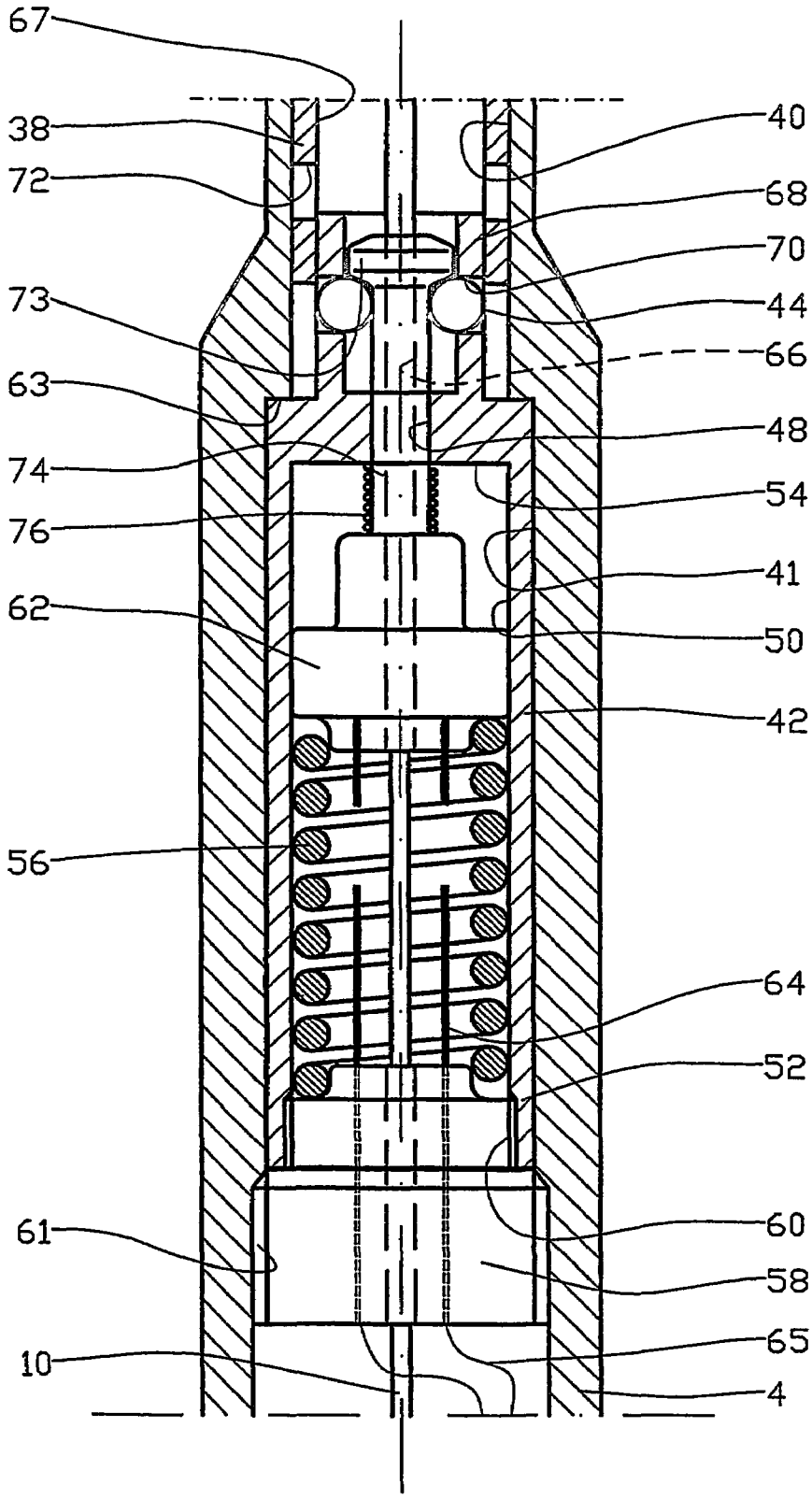
FIG. 8 shows the disconnection device when the wireline has been released, and the fastening sleeve is on its way out of the wireline tool.

When the release piston 62 is located in its releasing position, the bores 70 no longer correspond with the collar 73 on the piston-rod-resembling portion 74, whereby the locking bodies 44 due to their geometries are displaced radially inwards and out of their locking engagements with the bores 72. The fastening sleeve 38 thus may be displaced out of the locking neck 68, whereby the wireline 2 is disengaged from the wireline tool 4, cf. FIG. 8. The wireline 2 with the wireline connector 6 then may be retrieved to surface.

In an alternative embodiment, the wires 64 may be heated by means of chemical energy.

Figure 9:
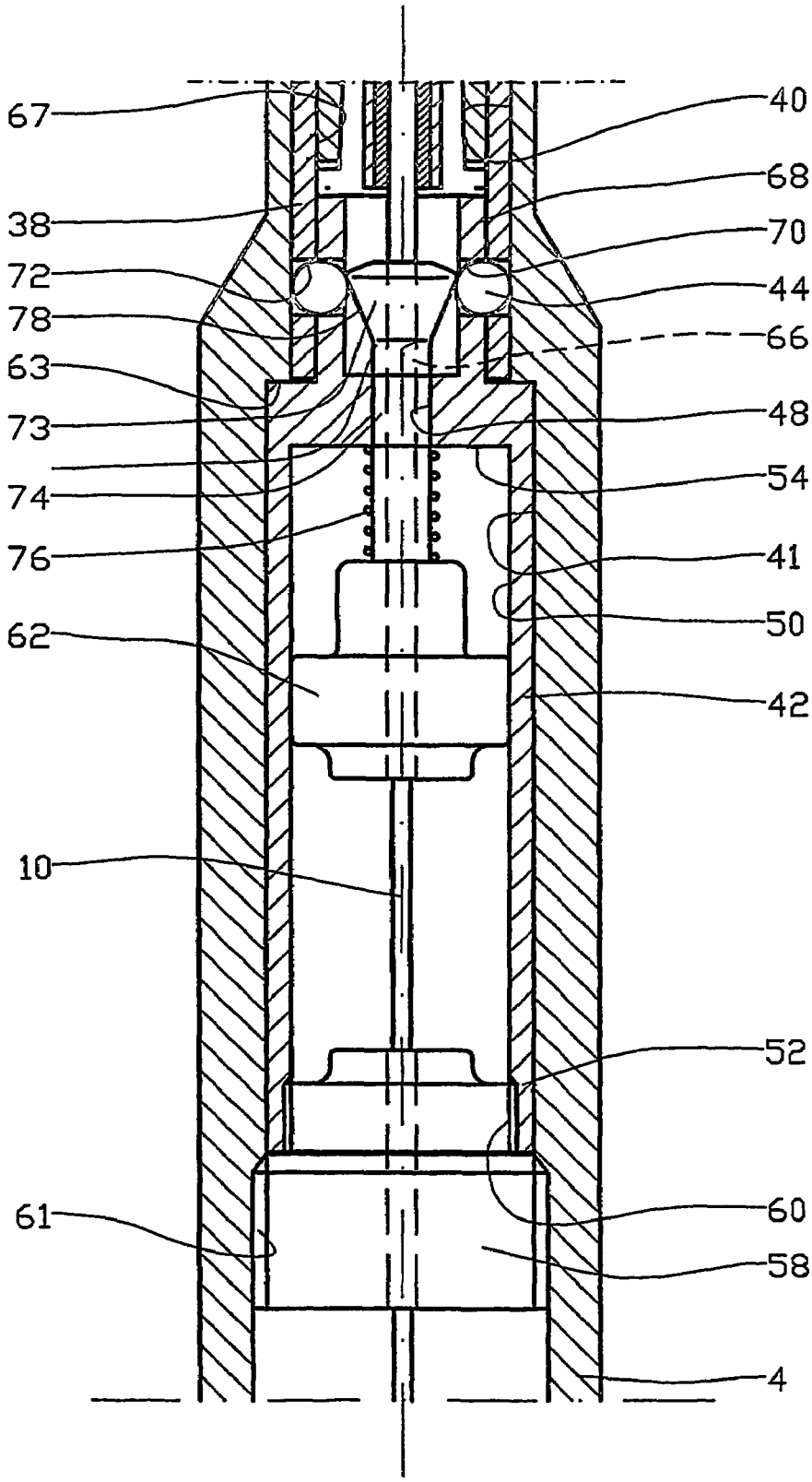
FIG. 9 shows the disconnection device in a locking position that is maintained by means of a collar on a release piston of the disconnection device.

In a further embodiment, the collar 73 may be provided with a tapered contacting surface 78 for the locking bodies 44, cf. FIG. 9.

In this embodiment, the biasing force of the support spring 76 is adapted, preferably by being adjustable using an adjusting device (not shown), in a manner allowing the collar 73 and the release piston 62 to be displaced axially at a predetermined pulling force within the fastening sleeve 38, and due to the radial compressive force from the locking bodies 44.

The invention claimed is:

1. A device for connection of a wireline having a wireline strand layer, the device comprising:

an inner sleeve, an outer sleeve, and a fastening element, wherein the inner and outer sleeves cooperate to bias and clamp the wireline strand layer between the inner sleeve and the outer sleeve, wherein the fastening element physically engages the outer sleeve.

2. The device according to claim 1, wherein the outer sleeve is provided with a biasing, radial deformation.

3. The device according to claim 1, wherein a spacer sleeve is arranged between the outer sleeves.

4. The device according to claim 1, wherein a wedge sleeve is biased and displaced axially between the outer sleeve and the inner sleeve.

5. The device according to claim 4, wherein the spacer sleeve is arranged between a second outer sleeve and a first wedge sleeve.

6. A device for connection, by means of a wireline connector of a wireline wherein the wireline connector is connected to a wireline tool by means of a releasable disconnection device, wherein the disconnection device comprises at least one locking body, wherein the locking body in its locking position is in locking engagement with the wireline connector and the disconnection device while a body prevents the locking body from being displaced out of its locking position, and wherein the body is arranged to displace out of its locking position by means of a biased spring.

7. The device according to claim 6, wherein the body is comprised of a collar that is connected to a piston-like body, the spring biasing against the piston-like body, and wherein the piston-like body is restrained by at least one electrically insulated wire, and wherein the wire upon heating is arranged to lose its load-carrying ability.

8. The device according to claim 7, wherein the wire is heated by means of electric energy.

9. The device according to claim 7, wherein the wire is heated by means of chemical energy.

10. The device according to claim 6, wherein disconnection device comprises at least one locking body, wherein the locking body in its locking position is in locking engagement with the wireline connector and the disconnection device while the locking body is bearing against a movable tapered section that is biased in its movement direction by a spring.

* * * * *